US012605763B2

(12) United States Patent
Xu et al.

(10) Patent No.: US 12,605,763 B2
(45) Date of Patent: Apr. 21, 2026

(54) METHOD FOR PREPARING ALUMINUM-BASED TUBULAR TARGET

(71) Applicants: Hebei Shenghua New Materials Technology Co., Ltd., Xingtai City (CN); Inner Mongolia University of Science & Technology, Baotou City (CN)

(72) Inventors: Pengguo Xu, Xingtai City (CN); Qun Li, Xingtai City (CN); Lilin Yang, Xingtai City (CN); Ting Su, Xingtai City (CN)

( * ) Notice: Subject to any disclaimer, the term of this patent is extended or adjusted under 35 U.S.C. 154(b) by 401 days.

(21) Appl. No.: 18/508,851

(22) Filed: Nov. 14, 2023

(65) Prior Publication Data

US 2024/0165702 A1 May 23, 2024

(30) Foreign Application Priority Data

Nov. 23, 2022 (CN) ..... 202211474565.4

(51) Int. Cl.

| | |
|---|---|
| ***B22F 7/04*** | (2006.01) |
| ***B22F 3/15*** | (2006.01) |
| ***B22F 3/24*** | (2006.01) |
| ***B22F 5/10*** | (2006.01) |
| ***B22F 9/04*** | (2006.01) |

(52) U.S. Cl.

CPC ..... *B22F 7/04* (2013.01); *B22F 3/15* (2013.01); *B22F 3/24* (2013.01); *B22F 5/106* (2013.01); *B22F 9/04* (2013.01); *B22F 2009/043* (2013.01); *B22F 2201/20* (2013.01); *B22F 2301/052* (2013.01); *B22F 2998/10* (2013.01)

(58) Field of Classification Search

CPC .... B22F 7/04; B22F 5/106; B22F 3/15; B22F 9/04; B22F 3/24

See application file for complete search history.

(56) References Cited

FOREIGN PATENT DOCUMENTS

| | | |
|---|---|---|
| CN | 114635063 A | 6/2022 |
| CN | 115233169 A | 10/2022 |

OTHER PUBLICATIONS

First Office Action for 202211474565.4, dated Mar. 15, 2025. China National Intellectual Property Office, Beijing, China.

*Primary Examiner* — Jessee R Roe

(74) *Attorney, Agent, or Firm* — Sandy Lipkin

(57) ABSTRACT

The disclosure belongs to the technical field of powder metallurgy, and provides a method for preparing an aluminum-based tubular target. The method includes: sleeve assembly, raw material mixing, powder filling, sleeve degassing, hot isostatic pressing, and finished product processing.

8 Claims, 8 Drawing Sheets

METHOD FOR PREPARING ALUMINUM-BASED TUBULAR TARGET

CROSS-REFERENCE TO RELATED APPLICATION

This patent application claims the benefit and priority of Chinese Patent Application No. 202211474565.4 filed with the China National Intellectual Property Administration on Nov. 23, 2022, the disclosure of which is incorporated by reference herein in its entirety as part of the present application.

TECHNICAL FIELD

The present disclosure relates to the technical field of powder metallurgy, in particular to a method for preparing an aluminum-based tubular target.

BACKGROUND

Physical vapor deposition technology is used to prepare thin films and coatings on surfaces of workpieces for mechanical or optoelectronic purposes, which has a wide range of applications in the fields of semiconductors, microelectronics, magnetic recording, tooling, and decoration. A target, as a source material of the physical vapor deposition technology, is a key material for the preparation of thin films and coatings. At present, there are mainly two types of targets by shape, i.e., planar targets and tubular targets. The planar targets have a utilization rate of only 20% to 30%, which is far lower than an approximately 70% utilization rate of the tubular targets. As a result, the low utilization rate of the planar targets results in a large waste of the source material. Therefore, the tubular targets are currently a development trend of future targets.

Coating layers of nitride prepared by aluminum-based targets on tools, molds, and mechanical parts make it possible to achieve wear-resistant and anti-corrosion effects, which could greatly improve a service life of the product. Tubular aluminum-based targets have broad application prospects in the field of film or coating preparation by physical vapor deposition because of their high utilization rate.

In the existing preparation method, two layers of sleeves, i.e., inner sleeves and outer sleeves, are used, where a back tube is sleeved outside the inner sleeve, and then an evenly mixed titanium-aluminum powder is loaded between an outer wall of the back tube and the outer sleeve. A degassing tube is placed on a side wall of the outer sleeve, and after degassing, hot isostatic pressing is conducted to prepare a tubular blank, and then the tubular blank is machined into a tubular chrome-aluminum target. However, this method has the following defects: (1) since there is a need of the inner sleeve and outer sleeve, a large welding workload is required; (2) the inner sleeve could expand outward during the hot isostatic pressing, such that the outer wall of the inner sleeve needs to be closely attached to the inner wall of the back tube, otherwise the inner sleeve may swell and crack during the hot isostatic pressing.

Considering the problems existing in the prior art, the present disclosure provides a method for preparing a tubular aluminum-based target.

SUMMARY

In order to solve the above-mentioned defects in the prior art, the present disclosure provides a method for preparing an aluminum-based tubular target.

In the present disclosure, the method for preparing the aluminum-based tubular target is realized through the following technical solutions:

A method for preparing an aluminum-based tubular target, including the following steps:

- step 1, sleeve assembly: arranging a bonding layer on an outer wall of a back tube, and forming a sleeve structure on an outer side of the bonding layer, the sleeve structure having a cavity with a through hole on an upper end of the sleeve structure, where the bonding layer is made of zinc or a zinc-aluminum alloy;
- step 2, raw material mixing: providing raw materials of the aluminum-based tubular target, mixing the raw materials to be uniform by ball milling to obtain a filling material;
- step 3, powder filling: completely filling the cavity with the filling material through the through hole to obtain a powder-filled sleeve;
- step 4, sleeve degassing: subjecting the powder-filled sleeve to high-temperature degassing to obtain a degassed sleeve;
- step 5, hot isostatic pressing: subjecting the degassed sleeve to hot isostatic pressing to obtain an ingot; and
- step 6, finished product processing: processing the ingot to obtain the aluminum-based tubular target.

In some embodiments, the method is conducted based on a sleeve module. The sleeve module includes a sleeve shell, a sleeve upper cover, a sleeve lower cover, a mandrel, a back tube, an upper limit ring, and a lower limit ring, and the upper limit ring has a through hole. The method includes the following steps:

- step 1, sleeve module:
  - arranging a sleeve lower cover at a bottom end of an inner side of a sleeve shell;
  - preparing a bonding layer on an outer wall of a back tube, inserting a mandrel into the back tube, and placing the back tube into the sleeve shell; and fixing an upper end and a lower end of the back tube by an upper limit ring and a lower limit ring, respectively, such that a cavity with a through hole is formed between the sleeve shell, the bonding layer, the lower limit ring, and the upper limit ring;
- step 2, raw material mixing: providing raw materials of the aluminum-based tubular target, mixing the raw materials to be uniform by ball milling to obtain a filling material;
- step 3, powder filling: completely filling the cavity with the filling material through the through hole of the upper limit ring; and arranging a sleeve upper cover connected with a degassing tube on an inner side of an upper end of the sleeve shell, and aligning an outer edge of the sleeve upper cover with an upper edge of the sleeve shell to obtain a powder-filled sleeve;
- step 4, sleeve degassing: subjecting the powder-filled sleeve to high-temperature degassing, and sealing the degassing tube to obtain a degassed sleeve;
- step 5, hot isostatic pressing: subjecting the degassed sleeve to hot isostatic pressing to obtain an ingot of the aluminum-based tubular target; and
- step 6, finished product processing: processing the mandrel in the ingot of the aluminum-based tubular target to obtain the aluminum-based tubular target.

In some embodiments, the raw materials include aluminum and other components; and the other components are one or more selected from the group consisting of titanium, chromium, silicon, boron, molybdenum, tungsten, and vanadium.

In some embodiments, a molar percentage of aluminum atoms is greater than 10% and less than 99%.

In some embodiments, the aluminum and the other raw components each are in a powder form, and have a powder particle size of less than 500 μm.

In some embodiments, the high-temperature degassing is conducted at a temperature of 300° C. to 400° C. and a vacuum degree of not greater than $2\times10^{-3}$ Pa for 4 h to 16 h.

In some embodiments, the hot isostatic pressing is conducted at a temperature of 400° ° C. to 600° C. and a pressure of 60 MPa to 150 MPa for 2 h to 5 h.

In some embodiments, the ball milling is conducted at a ball-to-material ratio of 1:4 and a speed of 30 r/min to 60 r/min for 4 h to 10 h.

In some embodiments, the back tube is made of a material that is any one selected from the group consisting of stainless steel, titanium, a titanium alloy, copper, and a copper alloy.

In some embodiments, the bonding layer is made of zinc or a zinc-aluminum alloy.

In some embodiments, the mandrel is made of a material that is any one selected from the group consisting of graphite, aluminum, and an aluminum alloy; and the mandrel has a greater height than that of the back tube.

In some embodiments, the upper limit ring has an inner diameter greater than an outer diameter of the mandrel, and the upper limit ring has an outer diameter smaller than an inner diameter of the sleeve shell.

In some embodiments, the lower limit ring has an inner diameter greater than an outer diameter of the back tube, and the lower limit ring has an outer diameter smaller than an inner diameter of the sleeve shell.

In some embodiments, the sleeve shell is made of aluminum or an aluminum alloy.

In some embodiments, the degassing tube is made of aluminum or an aluminum alloy.

In some embodiments, the upper limit ring is made of aluminum or an aluminum alloy.

In some embodiments, the lower limit ring is made of aluminum or an aluminum alloy.

Compared with the prior art, the present disclosure has the following beneficial effects:

In the method for preparing the aluminum-based tubular target of the present disclosure, the aluminum powder and one or more powders of titanium, chromium, silicon, boron, molybdenum, tungsten, and vanadium are directly bonded to the back tube by hot isostatic pressing. Forming of the target and binding of the target and the back tube are combined into one step, which omits a binding process, thereby significantly shortening a production cycle and reducing a production cost.

In the present disclosure, metal zinc or a zinc alloy is selected as a bonding layer between the target and the back tube, and a melting temperature of the bonding layer could be increased to above 420° C. This avoids that when high-power sputtering is conducted, a bonding surface between the tube and target is prone to overheating and the bonding layer (such as a traditional indium bonding layer) is melted, thus eventually causing the target to fall off and bulge, and the bonding layer to flow into a sputtering chamber. In this way, the best conditions are provided for high-power and rapid sputtering.

In the present disclosure, the raw materials of the filling material are mixed to be uniform by ball milling, which could not only ensure uniformity of the powder mixing, but also enhance interlocking of the powders; thus, a phenomenon of powder inhomogeneity could be avoided during the powder filling and a uniform distribution of target components could be ensured.

In the present disclosure, the method for preparing the aluminum-based tubular target is based on hot isostatic pressing. Due to a reasonable selection of a preparation temperature, it could not only ensure the compactness of the target, but also does not result in brittle intermetallic compounds such as titanium-aluminum and chromium-aluminum. The method of the present disclosure could not only prepare high-alumina tubular targets that cannot be prepared by traditional smelting processes, with a molar percentage of aluminum atoms of greater than 10% and less than 99%, but also realize the production of targets with complex shapes as the target is easy to form with low processing difficulty. The method of the present disclosure provides a useful reference for the preparation process of aluminum-based tubular targets.

In the present disclosure, the aluminum-based target prepared by hot isostatic pressing has a high target density and no pores.

In the present disclosure, the sleeve module is assembled such that the cavity with the through hole is formed between the sleeve shell, the bonding layer, the lower limit ring, and the upper limit ring. Through the through hole, a ball-milled uniform filling material is filled into the cavity, followed by high-temperature degassing, hot isostatic pressing and finished product processing in sequence.

DETAILED DESCRIPTION OF THE EMBODIMENTS

Figure 1:
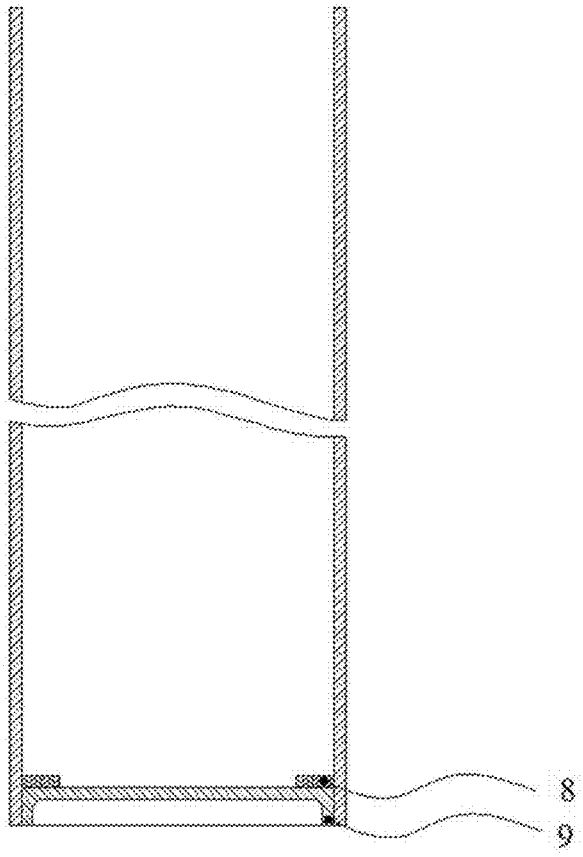
FIG. 1 is a schematic structural view showing that the sleeve lower cover and the lower limit ring are arranged in the sleeve shell in Example 1.

The technical solutions in the embodiments of the present disclosure will be clearly and completely described below in combination with the accompanying drawings in the embodiments of the present disclosure.

Example 1

Referring to FIG. 1 to FIG. 11, a method for preparing an aluminum-based tubular target was provided, including the following steps:

Step 1, sleeve assembly: a bonding layer 10 was arranged on an outer wall of a back tube 6, and a sleeve structure was formed on an outer side of the bonding layer 10; where the sleeve structure had a cavity with a through hole on its upper end.

It should be noted that, in the present disclosure, there is no limitation on a preparation method of the sleeve structure with the cavity having the through hole, as long as the sleeve could be prepared according to actual needs, and a through hole is left at the upper end of the sleeve to facilitate the filling material to be filled in the cavity. Optionally, a sleeve module used in this example is consisted of a sleeve shell 5, a sleeve upper cover 2, a sleeve lower cover 9, a mandrel 7, a back tube 6, an upper limit ring 4, and a lower limit ring 8; and the sleeve module was prepared by the following steps:

Referring to FIG. 1, the sleeve lower cover 9 was arranged at a bottom end of an inner side of the sleeve shell 5, such that an outer edge of the sleeve lower cover 9 was aligned with a lower edge of the sleeve shell 5; the lower limit ring 8 was arranged on the sleeve lower cover 9, such that an edge of the lower limit ring 8 abutted against an inner wall of the sleeve shell 5.

Figure 2:
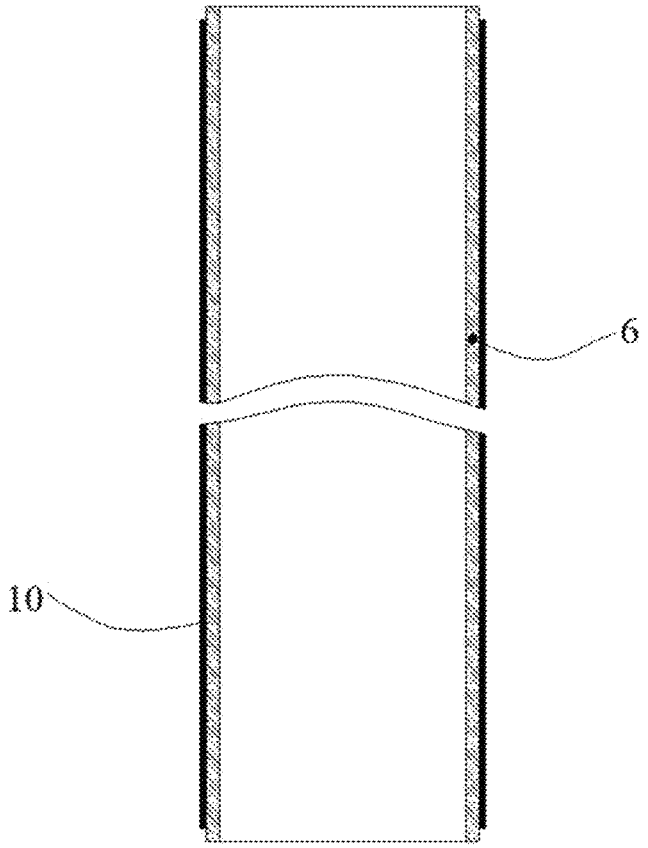
FIG. 2 is a schematic structural view showing that the back tube is provided with a bonding layer in Example 1.
Figure 3:
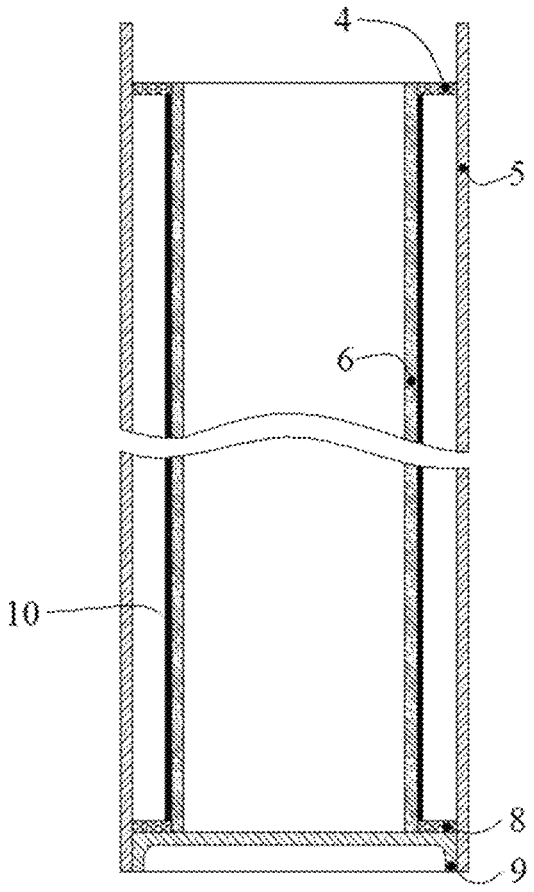
FIG. 3 is a schematic structural view showing that the back tube is arranged in the sleeve shell in Example 1.
Figure 4:
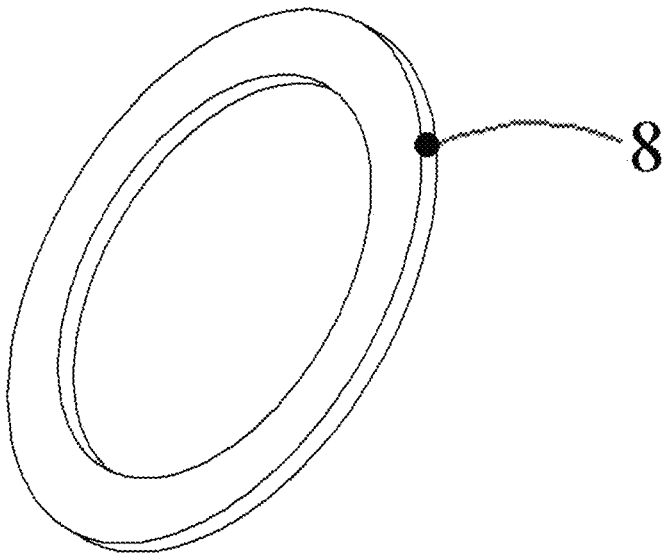
FIG. 4 shows a schematic structural view of the lower limit ring in Example 1.
Figure 5:
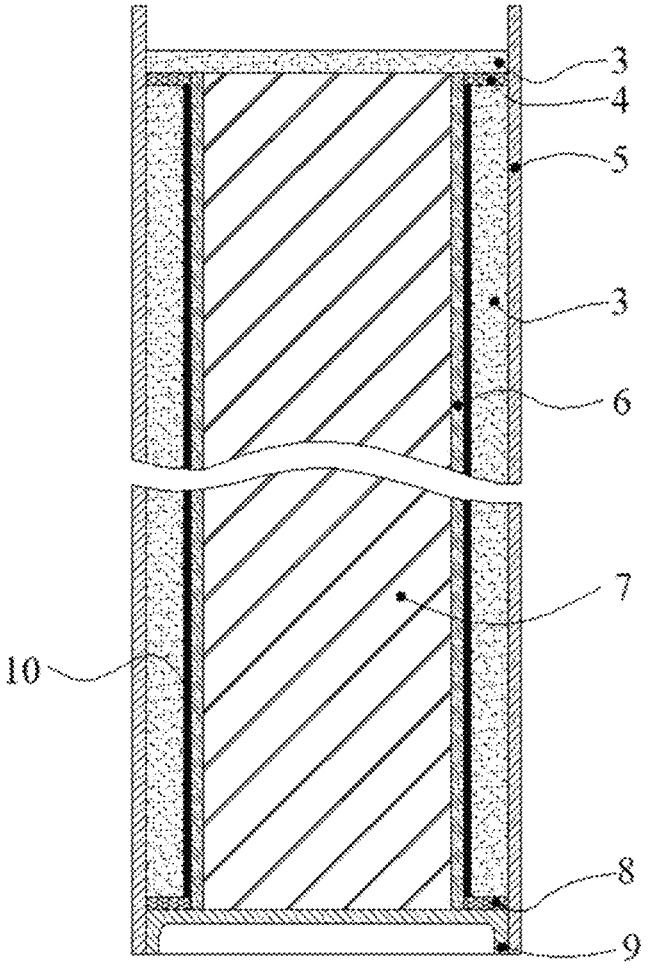
FIG. 5 is a schematic structural view showing the filling material is filled in Example 1.
Figure 6:
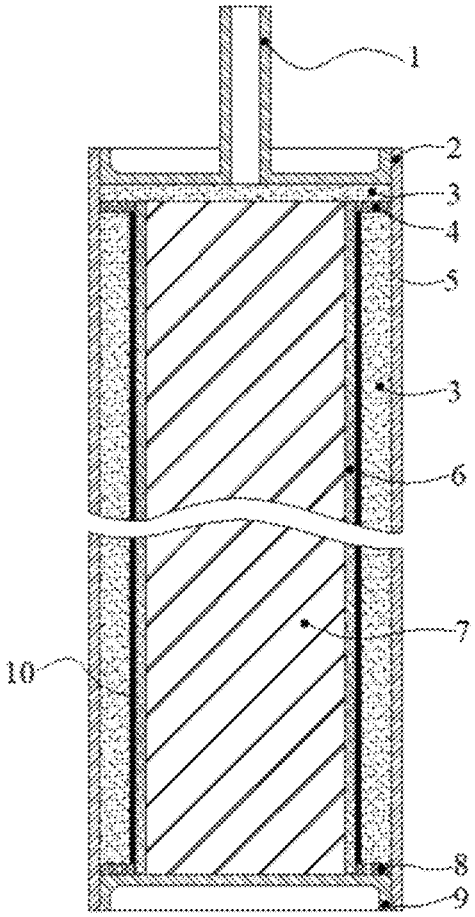
FIG. 6 shows a schematic structural view of the sleeve upper cover connected with a degassing tube in Example 1.

Referring to FIG. 2, a layer of bonding layer 10 was prepared on an outer wall of the back tube 6. Referring to FIG. 3, the bonding layer was placed into the sleeve shell 5 and a bottom of the bonding layer passed through the lower limit ring 8. A ring body with a through hole was used as the upper limit ring 4, which was sleeved on an upper end of the back tube, such that the cavity with the through hole above was formed between the sleeve shell 5, the bonding layer 10, the lower limit ring 8, and the upper limit ring 4.

It should be noted that, there is no limitation on a connection sequence between the components, as long as a cavity with an opening on the top could be formed between the sleeve shell 5, the bonding layer 10, the lower limit ring 8, and the upper limit ring 4, such that it is convenient to fill the cavity with the raw materials for preparing the aluminum-based tubular target.

It should be avoided that the raw materials for preparing the aluminum-based tubular target (i.e., the filling material) accidentally fell from the lower end of the sleeve shell, which was not conducive to the preparation of the tubular target. In this example, preferably, a ring-shaped flat plate shown in FIG. 4 was adopted and served as the lower limit ring 8, with a thickness of 3 mm, and the lower limit ring 8 was a ring-shaped flat plate. An inner diameter of the ring was greater than an outer diameter of the back tube 6. An outer diameter of the ring was smaller than an inner diameter of the sleeve to ensure the airtightness of the bottom of the cavity. In addition, the sleeve lower cover 9 was fixedly connected to an inner bottom end of the sleeve shell 5 by means of argon arc welding.

In order to avoid the decrease of the binding effect between the target and the back tube 6 in the subsequent heat treatment, causing the target to fall off, bulge, and the bonding layer to flow into the sputtering chamber, in this example, zinc foil was preferably selected as a material of the bonding layer 10.

Moreover, in order to avoid the influence of the material of the sleeve module on the composition of the target during the preparation, in this example, the sleeve shell 5, the sleeve upper cover 2, the sleeve lower cover 9, the degassing tube 1, the upper limit ring 4, and the lower limit ring 8 were all made of pure aluminum; the mandrel 7 was made of graphite, and the back tube 6 was made of 304 stainless steel.

Step 2, raw material mixing: raw materials of the aluminum-based tubular target were provided and mixed to be uniform by ball milling, to obtain a filling material 3.

It should be noted that the raw materials for preparing the aluminum-based tubular target could be weighed according to actual needs. In this example, optionally, 46.65 parts of a titanium powder and 53.35 parts of an aluminum powder were weighted and mixed to be uniform by ball milling to obtain the filling material 3. In this example, the titanium powder had a particle size of not greater than 300 mesh (i.e., the titanium powder passed through a 300 mesh sieve) and a purity of 99.6%; and the aluminum powder had a particle size of 200 mesh and a purity of 99.6%.

In this example, in order to improve the uniformity of the component distribution of the target, mechanical ball milling was conducted for mixing. This could not only improve the uniformity of powder component distribution, but also enhance interlocking of the powders, thereby avoiding a phenomenon of powder inhomogeneity during the powder filling and ensuring a uniform distribution of target components. The ball milling was conducted at a ball-to-material ratio of 1:4 at a speed of 30 r/min to 60 r/min for 4 h to 10 h.

Step 3, powder filling: the cavity was completely filled with the filling material 3 through the through hole to obtain a powder-filled sleeve.

It should be noted that, in this example, the cavity was completely filled with the filling material 3 through the through hole of the upper limit ring 4. The powder filled on an upper end of the upper limit ring 4 had a thickness of about 10 mm, referring to FIG. 5. Subsequently, the sleeve upper cover 2 connected with a degassing tube 1 was arranged on the inner side of the upper end of the sleeve shell 5, and an outer edge of the sleeve upper cover 2 was aligned with the upper edge of the sleeve shell 5 to obtain a powder-filled sleeve, referring to FIG. 6.

Figure 7:
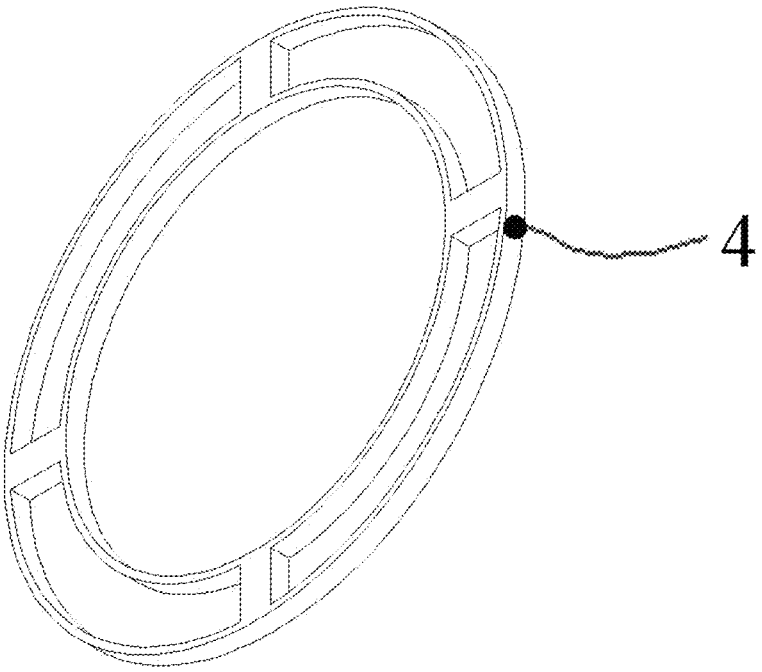
FIG. 7 shows a schematic structural view of the upper limit ring in Example 1.

In order to facilitate the filling of the raw materials for preparing the aluminum-based tubular target (i.e., the filling material), in this example, another ring-shaped flat plate is shown in FIG. 7 was used as the upper limit ring 4. The upper limit ring 4 had a thickness of 3 mm, and an inner diameter of the upper limit ring 4 was greater than the outer diameter of the back tube 6, such that the upper limit ring 4 could be inserted into the back tube 6 and placed on the top of the back tube 6. The outer diameter of the ring was smaller than the inner diameter of the sleeve; a middle part between an inner ring and an outer ring of the upper limit ring 4 was provided with 4 circular through holes, such that the powder could be filled into the cavity between the sleeve and the back tube through these through holes.

Step 4, sleeve degassing: the powder-filled sleeve was subjected to high-temperature degassing with a degassing tube, and the degassing tube was sealed to obtain a degassed sleeve.

It should be noted that, in this example, the powder-filled sleeve was subjected to high-temperature degassing at a temperature of 350° C. and a vacuum degree of not greater than $2\times10^{-3}$ Pa for 10 h. After high-temperature degassing, the degassing tube 1 was flattened to a length of about 100 mm calculated from a position where the degassing tube contacted with the sleeve upper cover. An end of the sleeve upper cover 2 far away from the flattened edge was cut off, and quickly sealed by argon arc welding to obtain the "degassed sleeve".

Step 5, hot isostatic pressing: the degassed sleeve was subjected to hot isostatic pressing to obtain an ingot.

Figure 8:
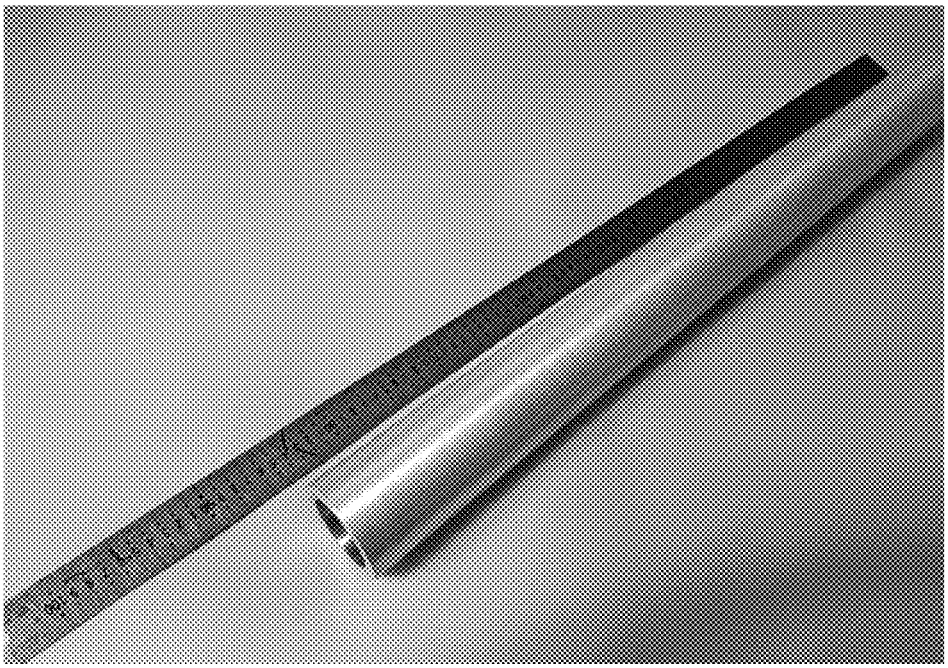
FIG. 8 shows a real picture of the tubular titanium-aluminum target prepared in Example 1.

It should be noted that, in this example, the degassing sleeve was placed in a hot isostatic pressing machine, and treated at 470° C. and 120 MPa for 3 h to obtain a "blank of the tubular target". The blank of the tubular target was processed into the "tubular target", as shown in FIG. 8.

Figure 9:
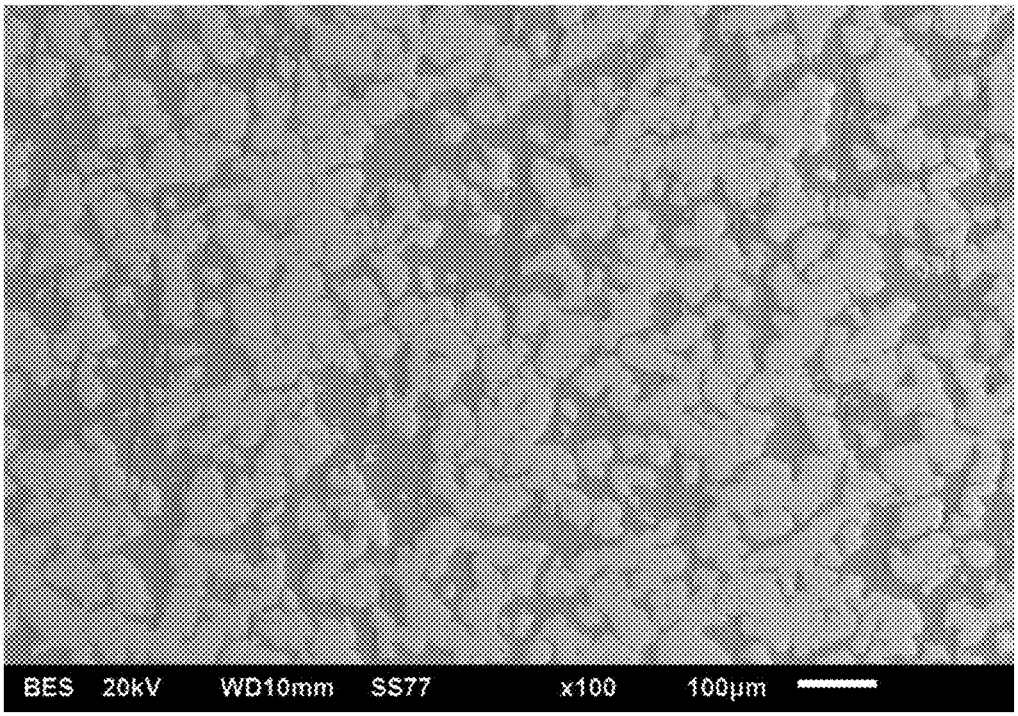
FIG. 9 shows a back scattering microscopy (×50 times) image of a titanium-aluminum 33/67 at % tubular target prepared in Example 1.
Figure 10:
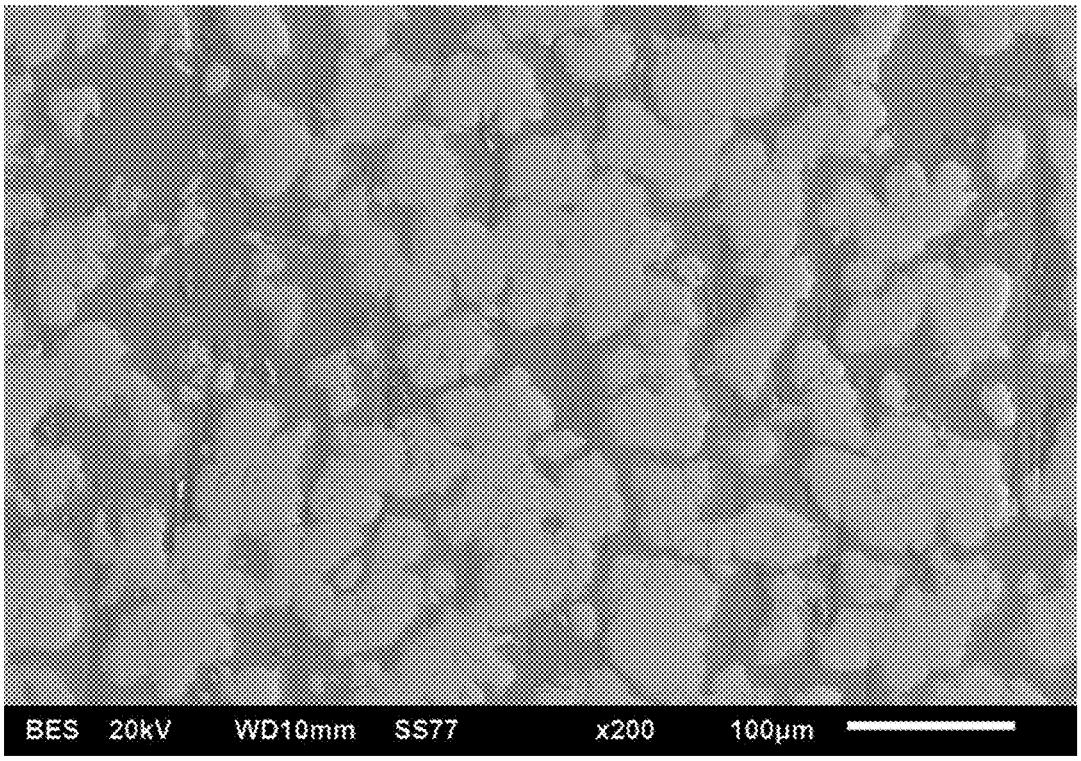
FIG. 10 shows a back scattering microscopy (×200 times) image of a titanium-aluminum 33/67 at % tubular target prepared in Example 1.

In this example, a microscopic appearance of the target was observed with a scanning electron microscope. FIG. 9 and FIG. 10 were back scattering images at different magnification times, in which the white ones were titanium particles and the black ones were aluminum particles. It can be seen from FIG. 9 and FIG. 10 that the titanium-aluminum target prepared by the method of the present disclosure shows uniform element distribution and compact structure.

Figure 11:
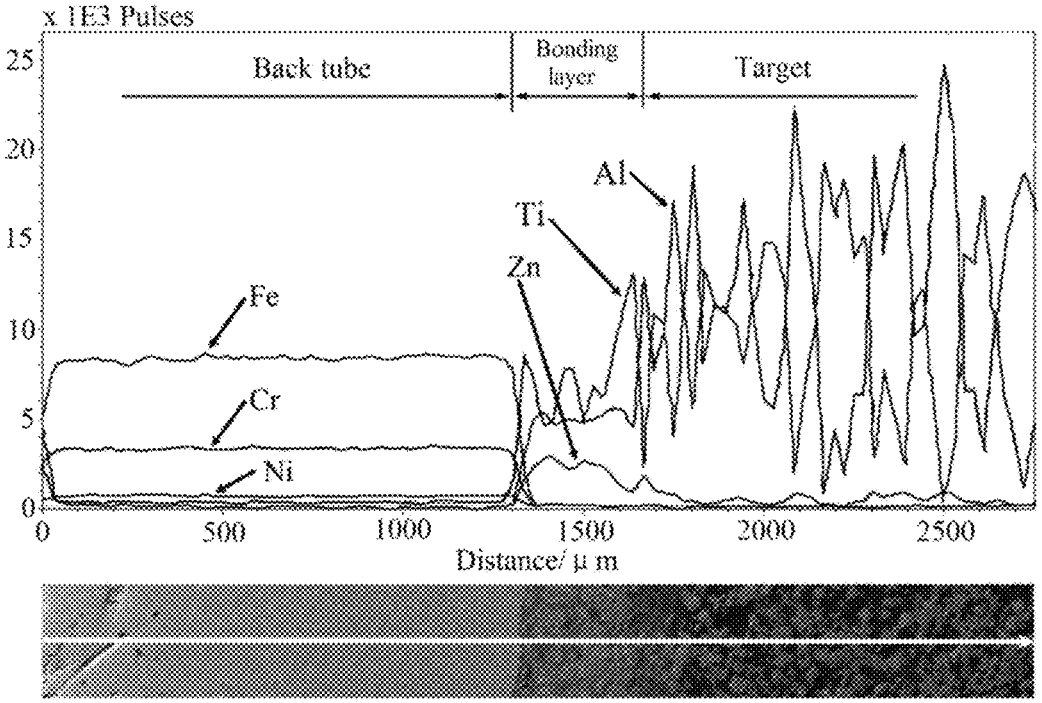
FIG. 11 shows a microscopic appearance of the tubular titanium-aluminum target "back tube+bonding layer+target" prepared in Example 1 and line-scanning results of compositions contained therein.

In this example, zinc was selected as the bonding layer, and a microscopic appearance of the bonding layer was observed and analyzed by line scanning, as shown in FIG. 11. From FIG. 11, it can be seen that due to the existence of the zinc bonding layer, a 500 μm metallurgical transition layer was formed between the back tube and the target. The transition layer enhanced a connection strength between the target and the back tube, and heat transfer during the sputtering.

Example 2

This example provided a method for preparing an aluminum-based tubular target, which was performed according to Example 1 except that the high-temperature degassing was conducted at 300° C. for 16 h.

Example 3

This example provided a method for preparing an aluminum-based tubular target, which was performed according to Example 1 except that the high-temperature degassing was conducted at 400° C. for 4 h.

Example 4

This example provided a method for preparing an aluminum-based tubular target, which was performed according to Example 1 except that the hot isostatic pressing was conducted at 400° C. and 90 MPa for 5 h.

Example 5

This example provided a method for preparing an aluminum-based tubular target, which was performed according to Example 1 except that the hot isostatic pressing was conducted at 600° C. and 150 MPa for 5 h.

Example 6

This example provided a method for preparing an aluminum-based tubular target, which was performed according to Example 1 except that the bonding layer in step 1 was made of a zinc-aluminum alloy.

Example 7

This example provided a method for preparing an aluminum-based tubular target, which was performed according to Example 1 except that the mandrel 7 was made of aluminum.

Example 8

This example provided a method for preparing an aluminum-based tubular target, which was performed according to Example 1 except that the mandrel 7 was made of an aluminum alloy.

Example 9

This example provided a method for preparing an aluminum-based tubular target, which was performed according to Example 1 except that the back tube 6 was made of a titanium alloy.

Example 10

This example provided a method for preparing an aluminum-based tubular target, which was performed according to Example 1 except that the back tube 6 was made of a copper alloy.

Example 11

This example provided a method for preparing an aluminum-based tubular target, which was performed according to Example 1 except that the sleeve shell 5, the sleeve upper cover 2, the sleeve lower cover 9, the degassing tube 1, the upper limit ring 4, and the lower limit ring 8 each were made of pure aluminum.

The foregoing examples are merely intended to illustrate the technical ideas of the present disclosure, rather than limiting the scope of the present disclosure. Any variations made on the basis of the technical solutions based on the technical ideas proposed by the present disclosure should fall within the scope of the present disclosure. Technologies not involved in the present disclosure could be realized by existing technologies.

Apparently, the above described embodiments are merely a part rather than all of the embodiments of the present disclosure. All other embodiments obtained by those skilled in the art based on the embodiments of the present disclosure without creative efforts shall fall within the scope of the present disclosure.

What is claimed is:

1. A method for preparing an aluminum-based tubular target, comprising the following steps:

step 1, sleeve assembly: arranging a bonding layer (10) on an outer wall of a back tube (6), and forming a sleeve structure on an outer side of the bonding layer (10), the sleeve structure having a cavity with a through hole on an upper end of the sleeve structure;

wherein the bonding layer (10) is made of zinc or a zinc-aluminum alloy;

step 2, raw material mixing: providing raw materials of the aluminum-based tubular target, mixing the raw materials to be uniform by ball milling to obtain a filling material (3);

step 3, powder filling: completely filling the cavity with the filling material (3) through the through hole to obtain a powder-filled sleeve;

step 4, sleeve degassing: subjecting the powder-filled sleeve to high-temperature degassing with a degassing tube, and sealing the degassing tube to obtain a degassed sleeve;

step 5, hot isostatic pressing: subjecting the degassed sleeve to hot isostatic pressing to obtain an ingot; and step 6, finished product processing: processing the ingot to obtain the aluminum-based tubular target.

2. The method of claim 1, wherein the raw materials comprise aluminum and other components; and the other components are one or more selected from the group consisting of titanium, chromium, silicon, boron, molybdenum, tungsten, and vanadium.

3. The method of claim 2, wherein a molar percentage of aluminum atoms is greater than 10% and less than 99%.

4. The method of claim 1, wherein the filling material has a particle size of less than 500 μm.

5. The method of claim 1, wherein the high-temperature degassing is conducted at a temperature of 300° C. to 400° C. and a vacuum degree of not greater than $2\times10^{-3}$ Pa for 4 h to 16 h.

6. The method of claim 1, wherein the hot isostatic pressing is conducted at a temperature of 400° C. to 600° C. and a pressure of 60 MPa to 150 MPa for 2 h to 5 h.

7. The method of claim 1, wherein the ball milling is conducted at a ball-to-material ratio of 1:4 at a speed of 30 r/min to 60 r/min for 4 h to 10 h.

8. The method of claim 1, wherein the back tube (6) is made of a material that is any one selected from the group consisting of stainless steel, titanium, a titanium alloy, copper, and a copper alloy.

* * * * *